US005953438A

United States Patent [19]

Stevenson et al.

[11] Patent Number: 5,953,438

[45] **Date of Patent: *Sep. 14, 1999**

[54] PLANAR ELECTROMAGNETIC TRANSDUCER

[75] Inventors: Charles Stevenson, Auburn; Edward M. Porrazzo, Carmichael, both of Calif.

[73] Assignee: Chain Reactions, Inc., Carmichael, Calif.

[ * ] Notice: This patent is subject to a terminal disclaimer.

[21] Appl. No.: 08/954,993

[22] Filed: Nov. 6, 1996

Related U.S. Application Data

[63] Continuation of application No. 08/425,279, Apr. 20, 1995, abandoned, which is a continuation of application No. 08/268,070, Jun. 29, 1994, Pat. No. 5,430,805, which is a continuation of application No. 07/634,517, Dec. 27, 1990.

[51] Int. Cl.[6] ..... H04R 25/00

[52] U.S. Cl. ..... 381/431; 381/408; 381/401

[58] Field of Search ..... 381/203, 202, 381/196, 117, 190, 191, 173, 182, 186, 194, 401, 402, 408, 423, 431, FOR 156, FOR 163; 29/594, 609.1

[56] References Cited

U.S. PATENT DOCUMENTS

| | | |
|---|---|---|
| 1,403,849 | 1/1922 | Delany . |
| 1,643,791 | 9/1927 | Slepian . |
| 3,141,071 | 7/1964 | Rich . |
| 3,164,686 | 1/1965 | Tibbetts . |
| 3,209,084 | 9/1965 | Gamzon et al. . |
| 3,283,086 | 11/1966 | Evans . |
| 3,612,778 | 10/1971 | Murphy . |
| 3,631,450 | 12/1971 | Chalfant . |
| 3,674,946 | 7/1972 | Winey . |
| 3,729,257 | 4/1973 | Gunto et al. . |
| 3,829,623 | 8/1974 | Willis et al. . |
| 3,833,771 | 9/1974 | Collinson . |
| 3,869,397 | 3/1975 | Tellier . |
| 3,873,784 | 3/1975 | Doschek . |
| 3,898,598 | 8/1975 | Asahi . |
| 3,919,499 | 11/1975 | Winey . |
| 3,922,502 | 11/1975 | Tabuchi . |
| 3,922,503 | 11/1975 | Tabuchi . |
| 3,922,504 | 11/1975 | Kishikawa et al. . |
| 3,939,312 | 2/1976 | McKay . |
| 3,997,739 | 12/1976 | Kishikawa et al. . |
| 4,006,050 | 2/1977 | Hurst et al. . |
| 4,020,296 | 4/1977 | Dahlquist . |
| 4,037,061 | 7/1977 | Von Recklinghaus ..... 381/196 |
| 4,081,627 | 3/1978 | Crist . |
| 4,210,786 | 7/1980 | Winey . |
| 4,242,541 | 12/1980 | Ando . |
| 4,264,789 | 4/1981 | Kaizu et al. . |
| 4,276,452 | 6/1981 | Suyama et al. . |
| 4,319,096 | 3/1982 | Winey . |
| 4,337,379 | 6/1982 | Nakaya . |
| 4,384,173 | 5/1983 | Briefer et al. . |
| 4,385,210 | 5/1983 | Marquiss . |
| 4,395,592 | 7/1983 | Colangelo . |

(List continued on next page.)

FOREIGN PATENT DOCUMENTS

| | | |
|---|---|---|
| 26 08 071 | 9/1977 | Germany . |
| 57-30497 | 2/1982 | Japan . |
| AU83/00084 | 6/1983 | WIPO . |

*Primary Examiner*—Huyen Le
*Attorney, Agent, or Firm*—Townsend and Townsend and Crew; Guy W. Chambers

[57] ABSTRACT

An electromagnetic transducer diaphragm having an electrical conductor layer, with a conductor pattern, positioned between two insulating layers of a flexible, electrically-insulating material bonded together to protect the diaphragm. An electrical current can flow through the conductors to produce magnetic and electrostatic fields around said conductors which interact with an electromagnetic field to produce mechanical displacement of the diaphragm which in turn produces an audio signal. Non-ferrous supports can be used to support the diaphragm. A magnet or magnets may be used to create the electromagnetic field. The magnets can be bonded to the cross arms of the non-ferrous support.

22 Claims, 6 Drawing Sheets

U.S. PATENT DOCUMENTS 4,413,161 11/1983 Matsumoto et al. .
4,463,825 8/1984 Lerwill .
4,468,530 8/1984 Torgeson .
4,471,172 9/1984 Winey .
4,471,173 9/1984 Winey .
4,491,698 1/1985 Larson et al. .
4,544,805 10/1985 Sawafuji .
4,544,806 10/1985 Nieuwendijk et al. .
4,550,228 10/1985 Walker et al. .
4,612,420 9/1986 Nieuwendijk et al. .
4,653,103 3/1987 Mori et al. .
4,699,242 10/1987 Ono .
4,703,510 10/1987 Larson .
4,792,978 12/1988 Marquiss .
4,803,733 2/1989 Carver et al. .
4,837,838 6/1989 Thigpen et al. .
4,856,071 8/1989 Marquiss .
4,885,783 12/1989 Whitehead et al. .
4,894,742 1/1990 Saito et al. .
4,924,504 5/1990 Burton .
4,939,784 7/1990 Bruney .
5,003,609 3/1991 Muraoka .
5,003,610 3/1991 Adachi et al. .
5,117,463 5/1992 Oyaba et al. .
5,148,493 9/1992 Bruney .
5,297,214 3/1994 Bruney .

PLANAR ELECTROMAGNETIC TRANSDUCER

This is a Continuation of application Ser. No. 08/425.279, filed Apr. 20, 1995, now abandoned, the disclosure of which is incorporated by reference which is a continuation of application Ser. No. 08/268,070, filed Jun. 29, 1994, and now issued as U.S. Pat. No. 5,430,805 which was itself a continuation of application Ser. No. 07/634,517, filed Dec. 27, 1990, the disclosures of which are incorporated by reference.

INTRODUCTION

This invention relates to a planar electromagnetic transducer that is capable of transforming an electrical signal into movement of a diaphragm. It is also capable of transforming the movement of a diaphragm into an electrical signal. It can be used in loudspeakers, headphones, microphones, or other devices of a similar nature.

A discussion of the advantages and disadvantages of planar electromagnetic loudspeakers, and a description of the state of the art, is contained in U.S. Pat. No. 4,837,838, entitled "Electromagnetic Transducer of Improved Efficiency", which is incorporated by reference herein.

SUMMARY OF INVENTION

Prior electromagnetic transducers utilize a diaphragm with conductors on the surface of one or both sides of the diaphragm. These conductors can be wires attached by an adhesive or circuits plated to the diaphragm, either by completely plating the side of the diaphragm and etching away or otherwise removing the unwanted portions or by depositing the conductive traces on the diaphragm. Our invention improves on the state of the art in planar electromagnetic transducer diaphragms by providing an additional layer of insulating material over the conductors. This provides protection of the conductors against oxidation or other environmental damage, which allows the transducer to operate in a wider range of environments, such as high humidity or corrosive atmospheres. It also protects against mechanical damage, such as abrasion, to the conductors, and prevents open circuits in the conductive pattern.

The additional layer of insulating material also prevents the conductors from contacting the magnet assembly or other conductive parts of the transducer, reducing the possibility of short circuits. It also prevents the inadvertent touching by persons (e.g. by persons adjusting the speaker placement or by children) of the conductors on the diaphragm, and the resultant shock hazard. The multilayered design of the diaphragm also allows the use of different materials for each insulating layer. This can produce a change in the resonant frequency of the diaphragm, blending the resonant frequencies of the various layers so that any peaks are not pronounced. It can similarly be used to alter the effect on the diaphragm with changes in ambient temperature by using materials with different temperature coefficients.

Finally, the inclusion of insulating layers over the conductors permits the coil formed by the conductors on the diaphragm to have multiple conductors not only in the plane of the diaphragm, but also perpendicular to the plane of the diaphragm. This stacking of coils (or other form of conductors) provides more conductors within the magnetic or electrostatic flux field of the transducer, with a resulting increase in efficiency.

Our invention also provides an improved means for producing the magnetic field in which the diaphragm is placed when a magnetic field, rather than an electrostatic field, is used to implement the electromagnetic transducer. To achieve this objective, a non-ferrous support for the magnets is used. The non-ferrous support does not distort the magnetic field and can provide additional protection against a short circuit with the conductors on the diaphragm if an insulating plastic is used as the non-ferrous support. The non-ferrous support can also provide environmental protection to the magnets. The non-ferrous support can be any means (made of non-ferrous material) for supporting the magnets. The support can be, for example, cross-arms to which the magnets are attached (by bonding or otherwise) or a frame or block which supports the magnets.

The magnetic assembly can be produced using a novel technique that eliminates the difficulties associated with assembling a rigid structure having powerful permanent magnets. These magnets produce strong opposing forces between adjacent magnets on the same side of the diaphragm, and strong attractive forces between magnets on opposite sides of the diaphragm. This assembly technique results in a precisely aligned magnet structure, and a resulting improvement in the linearity and efficiency of the transducer.

These and other features of the invention will be more readily understood upon consideration of the attached drawings and of the following detailed description of those drawings and the preferred embodiment of the invention.

DESCRIPTION OF THE PREFERRED EMBODIMENTS

Figure 1:
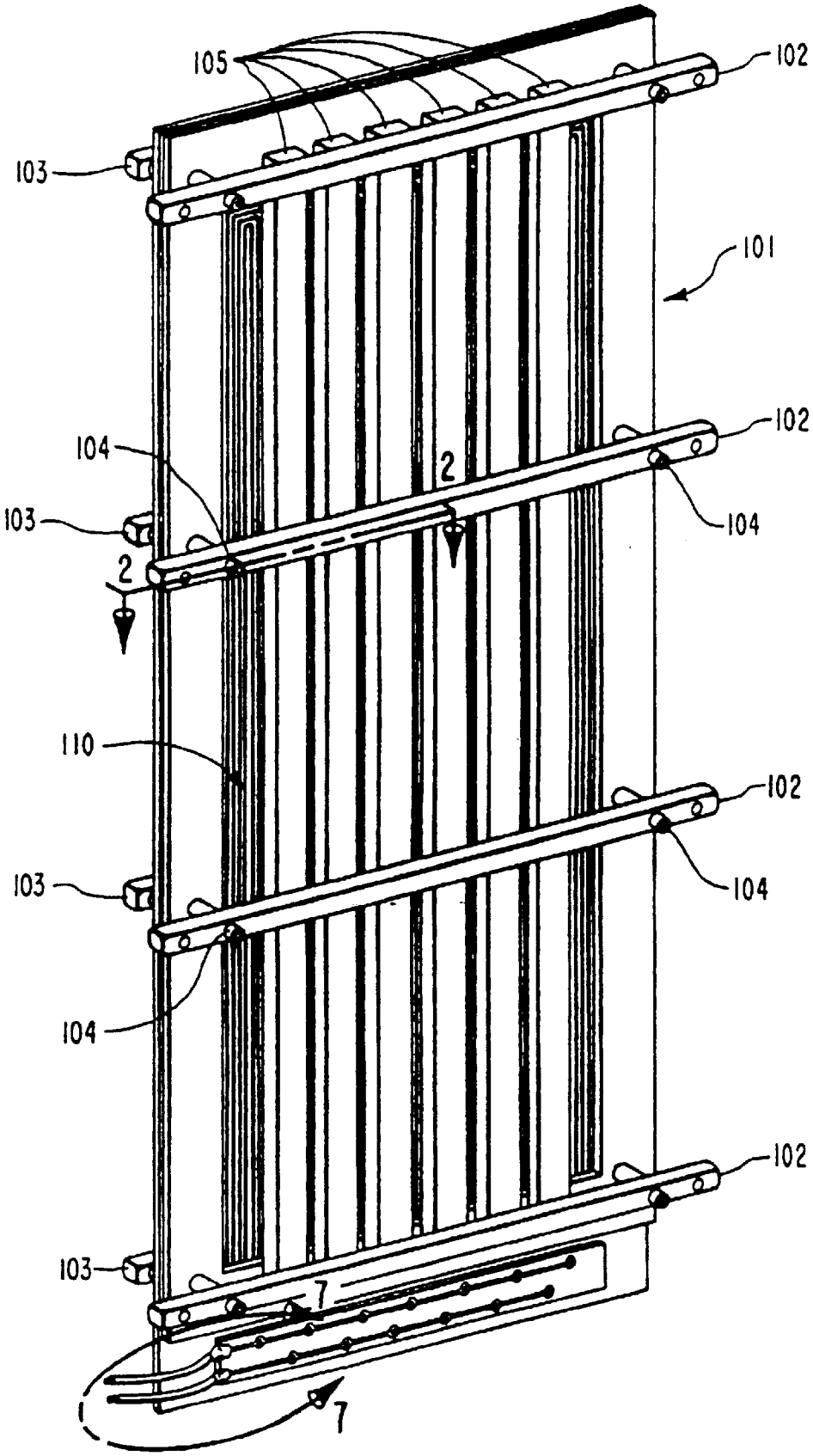
FIG. 1 depicts an embodiment of the inventive transducer when viewed from the front.
Figure 2:
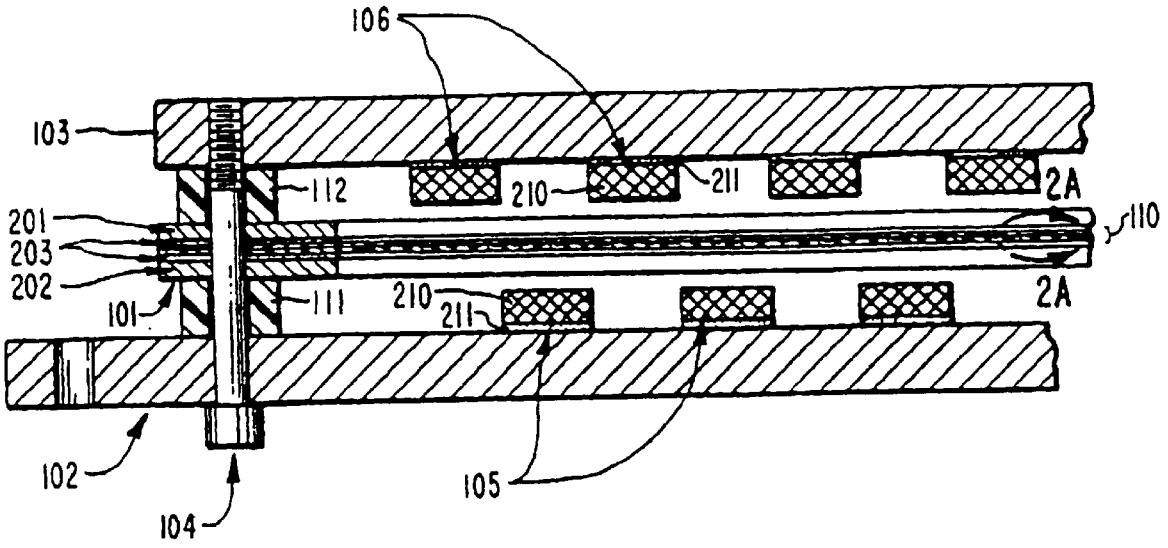
FIG. 2 is a cross-sectional view of the transducer at the cut point indicated in FIG. 1.

FIG. 1 depicts an embodiment of the planar electromechanical transducer as seen from the front of the transducer. FIG. 2 is a cross-sectional view of the transducer at the cut indicated on FIG. 1. With reference to FIG. 1, the major components of this embodiment of our electromagnetic transducer are a multilayered diaphragm 110, a frame 101 supporting diaphragm 110, and two magnet assemblies, one on each side of diaphragm 110. The front magnet assembly has a number of elongated permanent magnets 105 supported by cross-arms 102, while the back magnet assembly has permanent magnets 106 supported by cross-arms 103. The frame 101 and front and back magnet assemblies (i.e. magnets 105 with cross-arms 102 and magnets 106 with cross-arms 103) are joined together by screws 104 and spacers 111 and 112 as depicted in FIG. 2.

Figure 2A:
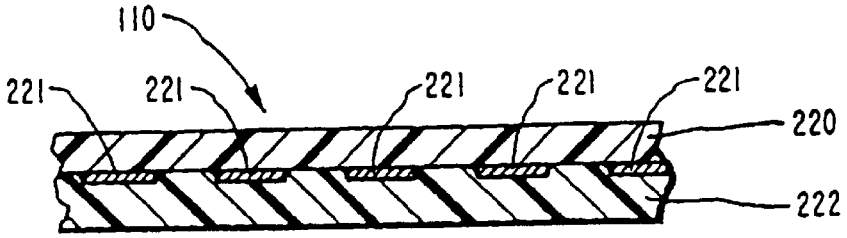
FIG. 2A depicts the cross-section of the diaphragm in greater detail.

Diaphragm 110 has three layers as depicted in FIG. 2A. An electrical conductor layer 221 is enclosed between two electrically-insulating layers 220 and 222. The electrical conductor layer 221 has one or more conductors (in this embodiment layer 221 has a plurality of conductors in the form of coils—see FIG. 5). In operation, electrical conductor layer 221 is suspended within an electromagnetic field. When an electrical current flows through the conductors, both magnetic and electrostatic fields develop around each conductor. These fields interact with the electromagnetic field in which the diaphragm is suspended, resulting in a force that displaces the diaphragm either toward the front or rear of the transducer, depending on the direction and magnitude of the current flowing through the conductors. This mechanical displacement of the diaphragm moves the surrounding air to create an audio signal corresponding to the electrical signal applied to the conductors, so that the transducer acts as a loudspeaker. A smaller version of the transducer could be used in a headphone.

Without any changes, this embodiment of the transducer can also generate an electrical signal based on the displacement of the diaphragm, as might be caused by audio vibrations from the surrounding air, permitting its use as a microphone. In this case, the movement of the conductors within the electromagnetic field induces a current flow in the conductors. These two modes of operation are common to most electromagnetic transducers. To simplify the following discussion, only the mode of operation where a signal source causes the displacement of the diaphragm is discussed, but it should be kept in mind that the inventive transducer can also be used to generate an electrical signal and, therefore has other applications (e.g. as a microphone).

Although the preferred embodiment uses permanent magnets to generate the electromagnetic field, there are a number of other techniques that can be employed without departing from the spirit of the invention. For example, the electromagnetic field can also be formed by one or more electromagnets or can be an electrostatic field, such as a field found between two charged plates.

In the preferred embodiment, the electromagnetic field is generated by the use of permanent magnets 105 and 106 supported by cross-arms 102 and 103 as shown in FIG. 2. Permanent magnets 105 are arranged so that they have the same polarity (either north or south) toward diaphragm 110 and permanent magnets 106 are arranged so they have the opposite polarity as magnets 105 toward diaphragm 110. The center-to-center spacing between magnets 105 is uniform and identical to the center-to-center spacing between magnets 106. Magnets 105 are offset from magnets 106 so that the centerline of each magnet 105 corresponds to the center of the space between two magnets 106 as shown in FIG. 2. This results in a linear pattern for the lines of flux between magnets 105 and 106.

Figure 3:
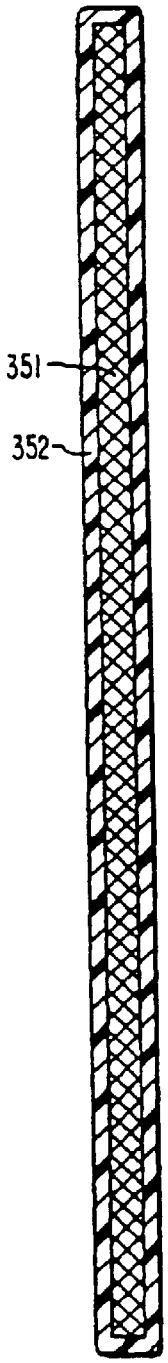
FIG. 3 depicts a possible means for supporting the magnets of the transducer.
Figure 4:
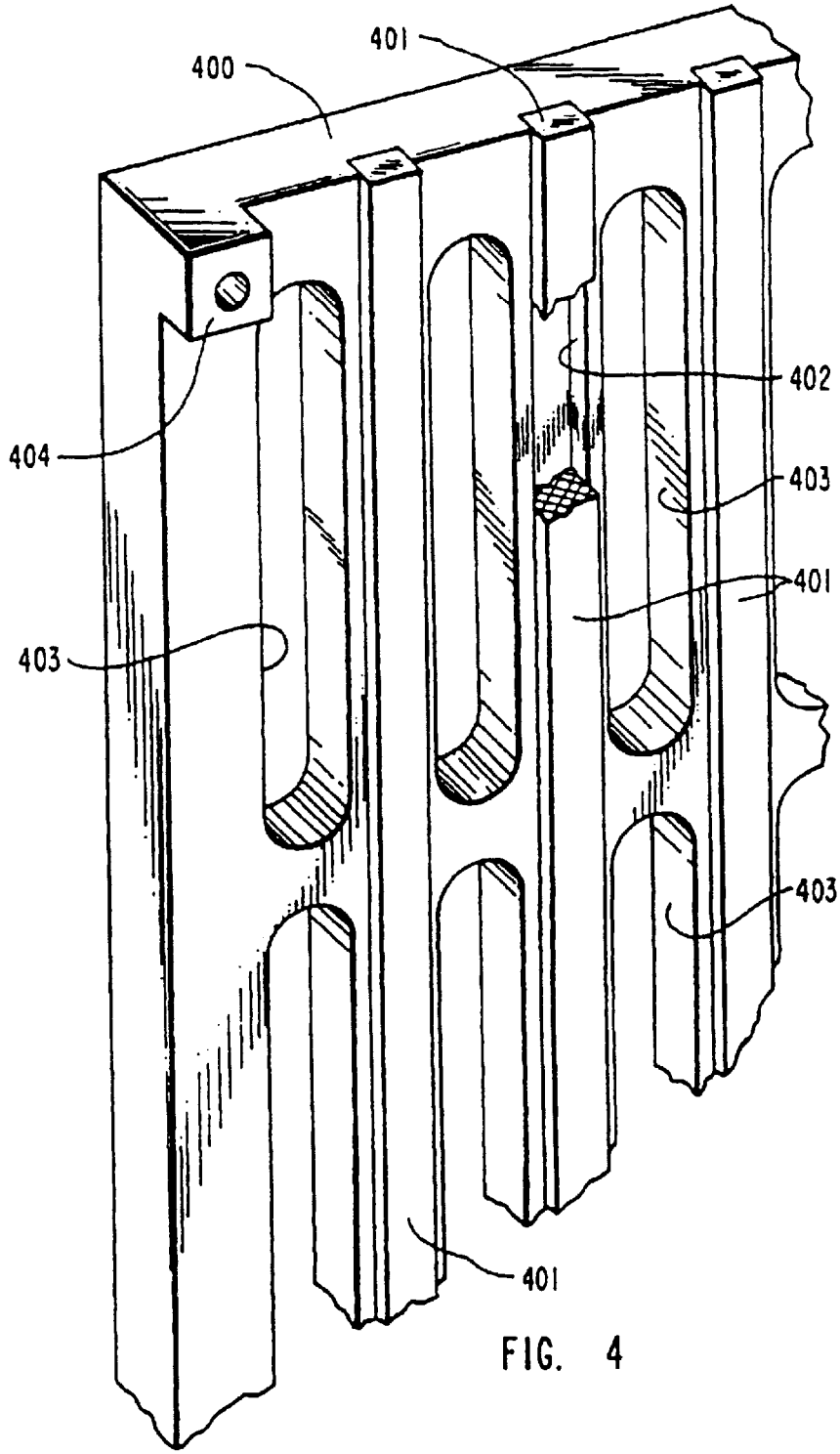
FIG. 4A depicts an alternative magnet support structure.
FIG. 4B depicts charging of a magnet structure according to an embodiment of the present invention.
FIG. 4C shows a pattern of conductors connected in parallel to a signal source.

There are a number of ways of attaching permanent magnets 105 and 106 to support cross-arms 102 and 103. In this preferred embodiment of the invention, as shown in FIG. 2, the castings of magnetic material 210 are bonded to backings 211 made of non-ferrous material, such as fiberglass or plastic. Magnetic material 210 can be bonded to backings 211 by epoxy resin or any other suitable means of bonding or attachment. Backings 211 are bonded to the cross-arms 102 or 103 using epoxy resin, plastic rivets or screws, or any other suitable means of attachment. Preferably the backing or other attachment means is made from a non-ferrous material so as to minimize any adverse effect on the linearity of the magnetic field. Non-ferrous material can also be used for cross-arms 102 and 103 to minimize unwanted coupling of magnetic fields of two adjacent magnets. The non-ferrous cross-arms provide the non-ferrous support for magnets 105 and 106. This non-ferrous support and the magnets form the magnetic assembly. Other forms of support for the magnetics can be used (e.g. see FIG. 4). As depicted in FIG. 3, the magnetic material (e.g. magnets) 351 can be enclosed in enclosure 352 which is a rectangular tube plastic extrusion (or other form of enclosure). Other enclosures or partial enclosures of nonferrous material can be used to enclose or partially enclose the magnetic material. The enclosure (or partial enclosure) can be color-coded to indicate the frequency range of the transducer or for other informational purposes. The non-ferrous material used for the support can be any non-ferrous material which has sufficient structural integrity to support magnets 105 and 106. Fiberglass and plastic are well suited for this purpose.

As depicted in FIG. 2, cross-arms 102 and 103 are attached to frame assembly 101 with screws 104. Frame 101 supports diaphragm 110. Spacers 111 and 112 separate cross-arms 102 and 103 from frame 101 by a fixed distance. The distance between diaphragm 110 and magnets 105 and 106 can be varied to produce transducers with different frequency response characteristics. An increase in distance results in a transducer with a lower frequency response.

FIG. 4A depicts an alternative means for supporting the magnets. Instead of cross-arms, a formed block of non-ferrous material 400 is used. The block functions as a frame which supports the magnets. Any plastic or other non-ferrous material with suitable strength can be utilized for this support. The block can be formed by many different methods including, but not limited to, thermo-forming, vacuum forming, injection molding, or machining. Machined into block 400 are channels 402 to hold magnets 401, and openings 403 that allow the sound produced by the transducer to leave the transducer. Magnets 401 are bonded to block 400 in channels 402 using epoxy resin or any other suitable means of attachment. Raised portions 404 of block 400 act as spacers 111 and 112 (depicted in FIG. 2) to provide a means of attachment to frame 101 supporting diaphragm 110.

The preferred technique for constructing the magnets is to use unmagnetized Alnico (aluminum, nickel and cobalt) alloy material, either precast into the desired elongated shape if the magnets are to be bonded to a non-ferrous backing support or as a powder poured into an extruded rectangular tube support. After all parts of the magnet assembly have been connected together, the entire assembly can be placed within an electromagnet or solenoid powered by the discharge of a capacitor bank. See FIG. 4B Activation of the electromagnet or solenoid produces a large electromagnetic pulse that magnetizes the magnetic material of the assembly with the desired polarity.

As shown in FIG. 2A, diaphragm 110 has an electrical conductor layer 221 (i.e. conductors 221) positioned between two layers of electrically-insulating material 220 and 222. Coils 221 may be connected in parallel to a signal source as shown in FIG. 4C. The materials for insulating layers 220 and 222 should be thick enough to prevent damage at the maximum excursion of diaphragm 110. However, if the materials are not flexible enough, a strong input signal will be necessary to produce the desired diaphragm displacements, resulting in low speaker efficiency. A 1 mil thin-film polyester, such as Mylar, for layer 220 and a 1 mil thin-film polyimide such as Kapton Type H, for layer 222 (both manufactured by E. I. DuPont de Nemours & Co., Inc.) have proven satisfactory. Different thicknesses and a broad range of electrically insulating materials can be used. Different electrically insulating materials can be used to alter the frequency response of the transducer. Because of the natural attraction between the Mylar and the Kapton layers, no adhesive or other means is needed to bond the two layers together. Preferably, the insulating materials are different and have an attraction to each other that facilitates bonding. Electrical conductor layer 221 is positioned between (and in this embodiment is enclosed by) insulating layers 220 and 222.

Electrical conductor layer 221 can be produced as light gauge wires sandwiched between insulating layers 220 and 222, by printing or plating the wires to one of the insulating layers, or by laminating or vapor depositing a metallic coating on one of the insulating layers, and then removing the metal by etching (or a similar process) from those areas where conductors are not desired. Any other means for producing one or more electrical conductors for the electrical conductor layer can be used in the practice of this invention.

For example, a metal removal method using an aluminized Mylar such as Colortone from Hurd Hastings can be employed to form one of the insulating layers and the conductors. A pattern consisting of the negative of the desired conductor pattern is printed on a sheet of paper using either an electrostatic copier or a laser printer. The side of the paper with the pattern is then placed against the aluminized side of the Mylar, and both are run through a heat and pressure fuser similar to one found on an electrostatic copier or laser printer. This results in the aluminum bonding to the negative pattern because of the pattern's higher temperature. When the-paper and the Mylar are separated, the desired conductor pattern remains on the Mylar.

As mentioned previously, diaphragm 110 is supported by frame 101. As seen in FIG. 2, frame 101 can be made from identical subframes 201 and 202. Diaphragm 110 is sandwiched between the two subframes, with double-sided adhesive strips 203 used to further secure diaphragm 110 to subframes 201 and 202.

Figure 5:
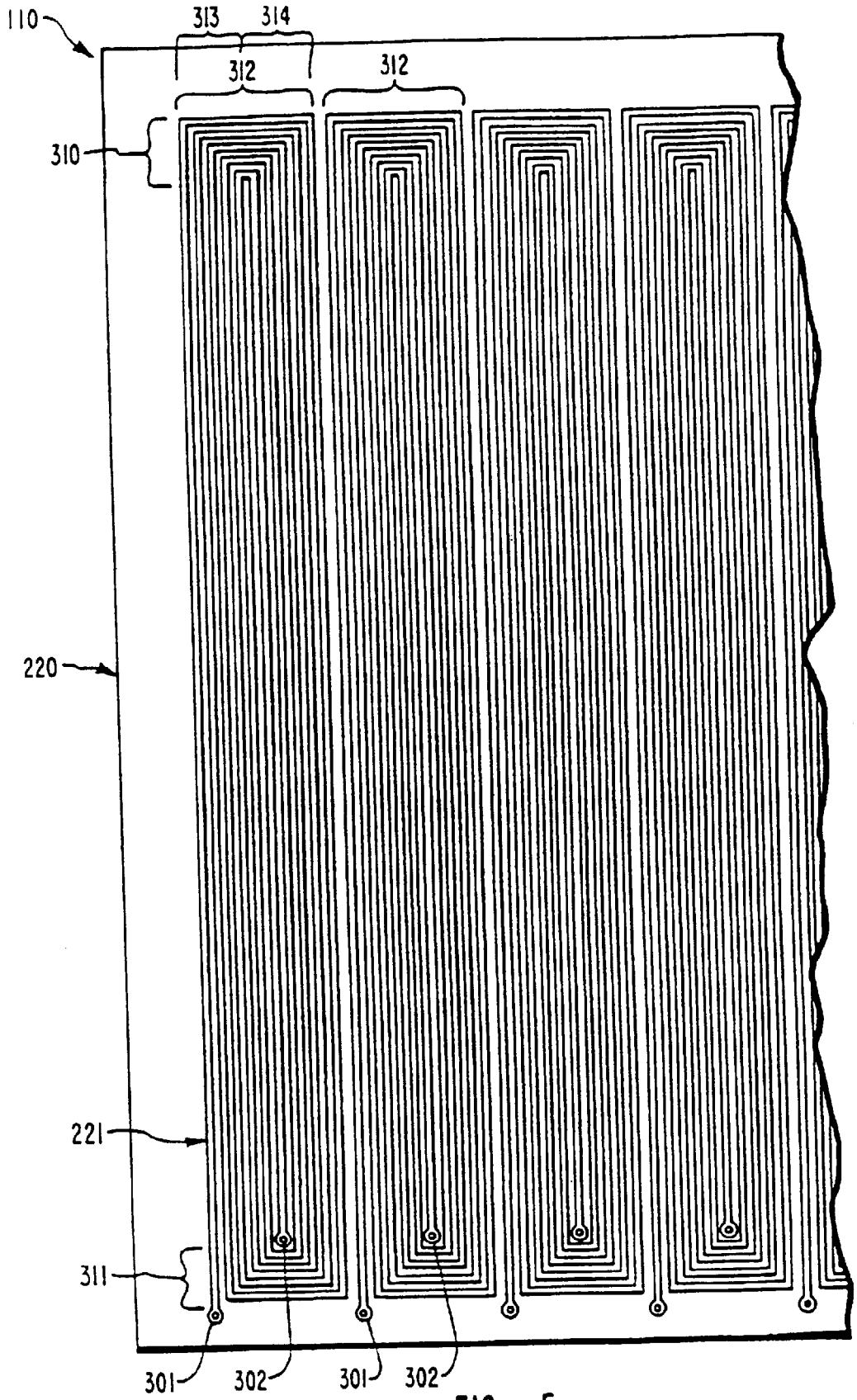
FIG. 5 depicts a possible pattern of conductors on the diaphragm.

As depicted in FIG. 5, the electrical conductors of layer 221 of diaphragm 110 are in the form of separate coils 312. When a voltage is placed across terminals 301 and 302, an electrical current flows such that the vertical direction of the current in coil region 313 is opposite the vertical direction of the current flowing in region 314. The length of coils 312 is such that horizontal conductor regions 310 and 311 are outside the principle magnetic flux field produced by magnets 105 and 106.

The width of each coil 312 is identical to the center-to-center spacing of magnets 105 (which, as previously discussed, is also the center-to-center spacing of magnets 106). Diaphragm 110 is positioned in frame 101 such that the center of each coil 312 corresponds to the center of each front magnet 105. The number of vertical conductor lines in regions 313 and 314 of coils 312 depend on the width of the conductor. A smaller conductor line width enables the placement of more conductor lines in the regions and thereby results in an increased impedance for the coils and also increases the force between the coil and the magnets, thus improving the efficiency of sound production.

Figure 6:
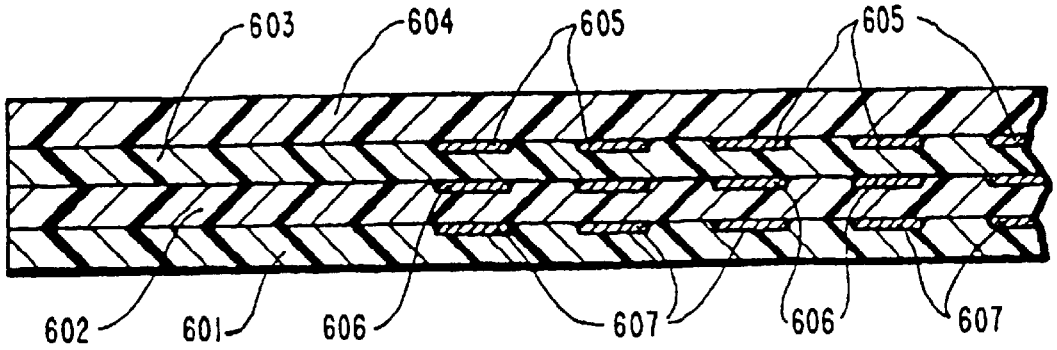
FIG. 6 depicts an alternative arrangement of conductors within the diaphragm allowing more than a single conductor layer.

FIG. 6 illustrates how the diaphragm can be further layered to permit a plurality of conductor layers. FIG. 6 depicts an implementation with three conductor layers 605, 606, and 606, contained within electrically insulating layers 601, 602, 603, and 604. Using a plurality of conductor layers such as shown in FIG. 6 allows more vertical conductors to be placed within the electromagnetic field, thereby improving the efficiency of the transducer. It should be noted that the depiction of three conductor layers in FIG. 6 is merely illustrative of how the invention allows a plurality of conductor layers, and should not be viewed as limiting the scope of the invention to a particular number of conductor layers.

Figure 7:
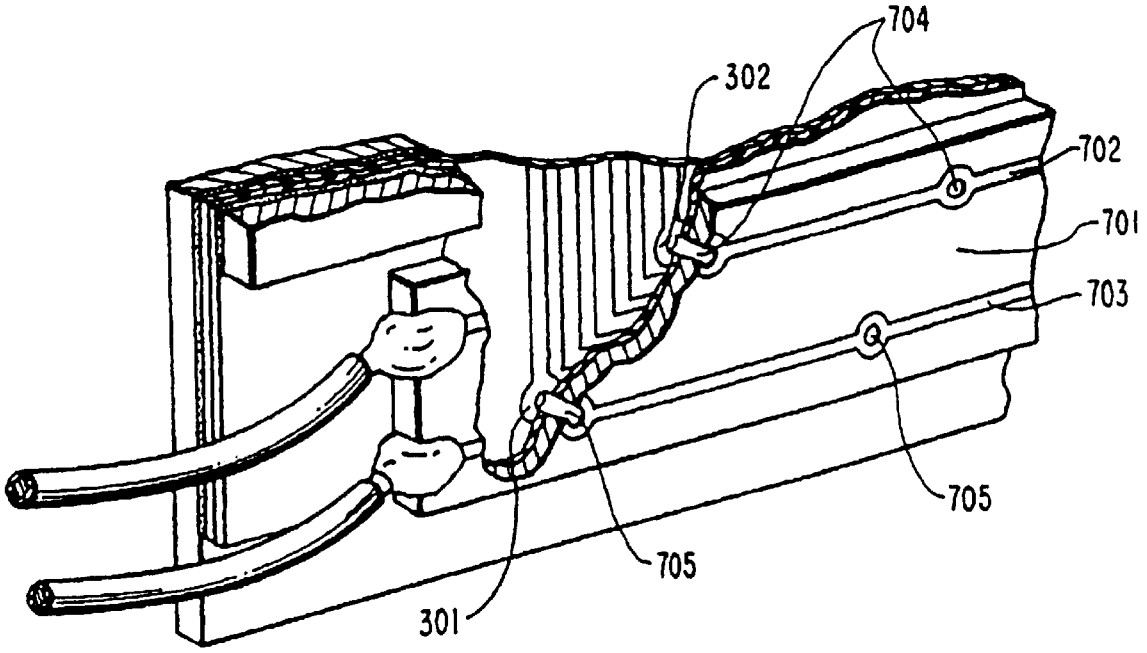
FIG. 7 is an exposed view at the point indicated in FIG. 1, depicting how distinct patterns of conductors are connected to an outside signal source.

As seen in FIG. 5, each coil has two terminals 301 and 302. FIG. 7 shows one possible way of connecting these coils together and to the signal source. Double-sided printed circuit card 701 contains conductive traces 702 and 703 on one side and plated-through holes 704 and 705 which provide an electrical connection to contact points 301 and 302 on the side of card 701 opposite the conductive traces 702 and 703. Contact point 705 is pressed against coil terminal 301 and contact point 704 is pressed against coil terminal 302 to provide the necessary electrical connections. Depending on the pattern of traces 702 and 703, the coils can be connected in series, parallel, or any other series-parallel configuration. A configuration means, such as switches, can be used to select different series-parallel configurations, allowing the user to alter the impedance of the transducer to match the signal source.

Figure 8:
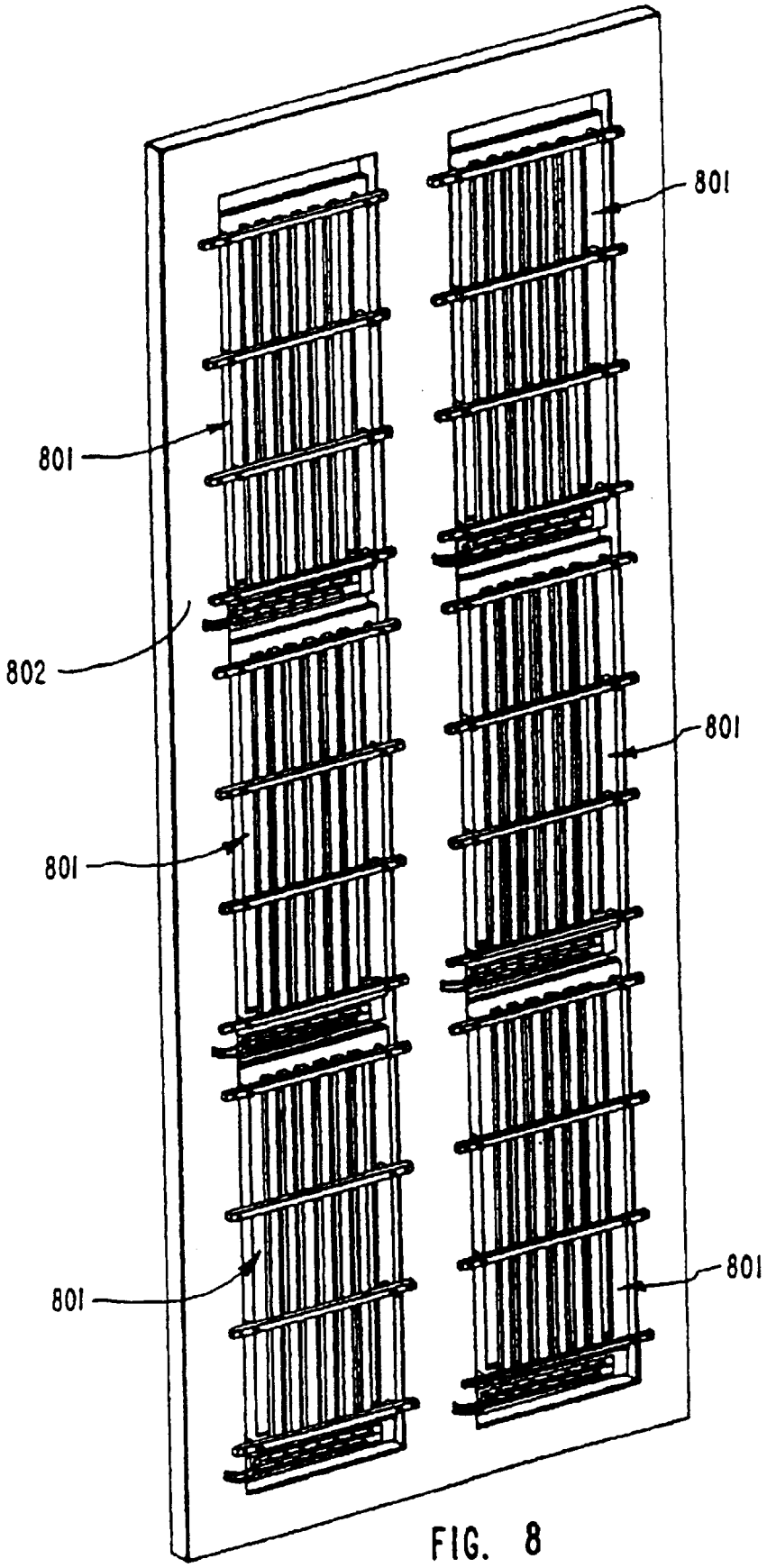
FIG. 8 depicts how multiple instances of the transducer can be connected to form a system.

FIG. 8 illustrates how two or more of our planar electromagnetic transducers can be combined to form a system capable of handling higher power, producing more acoustic energy, or providing better frequency response. Each transducer 801 is attached to a frame 802, which can be made of a material such as plastic, for good protection against environmental concerns, or wood, providing a pleasing appearance for a loudspeaker used in a home audio system.

The individual transducers of the system can be connected either as a series electrical circuit, giving a system impedance equal to the sum of the impedances of the transducers; a parallel circuit, giving a system impedance equal to the impedance of an individual transducer divided by the number of transducers; or a series-parallel circuit, giving an impedance somewhere between these two values. A configuration means, such as switches, can be used to select different series-parallel configurations, allowing the user to alter the impedance of the transducer to match the signal source.

Alternatively, the individual transducers can be configured with different frequency responses by using different materials for the diaphragm or by varying the distance between the diaphragm and the magnets. A frequency selective network, such as a cross-over network commonly employed in conventional speaker systems, can be used to route the appropriate frequency ranges from the input signal to the proper transducers. The techniques for connecting multiple transducers using a frequency selective network is well known to persons with ordinary skills in the art. To aid in the identification of transducers with particular frequency ranges, their diaphragms can be constructed from color-coded material and the magnet assemblies can be similarly color-coded.

It is to be understood that the above described arrangements are merely illustrative of numerous and varied other arrangements which may constitute applications of the principles of the invention. Such other may be readily devised by those skilled in the art without departing from the spirit or scope of this invention.

We claim:

1. A transducer comprising:

(a) a diaphragm comprised of:

(i) a first insulating layer of pliable, polymeric type electrically-insulating material, (ii) a second insulating layer of pliable electrically-insulating material, and (iii)an electrical conductor layer comprising a conductor pattern positioned between said first and second insulating layers, wherein both said first and second insulating layers are in direct and continuous contact with said electrical conductor layer;

(b) means for supporting said diaphragm; and (c) means for generating an electromagnetic field in which said diaphragm is placed, including at least one magnet.

2. The transducer of claim 1 wherein said transducer is an audio loudspeaker.

3. The transducer of claim 1 wherein said transducer is a microphone.

4. The transducer of claim 1 wherein the impedance of said conductor pattern is matched to the transducer signal source to generate electrical signals as an antenna.

5. The transducer of claim 1 wherein said conductor pattern is printed on said first insulating layer.

6. The transducer of claim 1 wherein said means for generating an electromagnetic field includes at least one magnet on one side of said diaphragm and at least one magnet on the other side of said diaphragm.

7. The transducer of claim 1 wherein said at least one magnet is magnetized after being assembled into said transducer.

8. The transducer of claim 7 wherein said at least one magnet is magnetized by discharge of a solenoid.

9. The transducer of claim 1 wherein said at least one magnet is formed by pouring a mixture containing unmagnetized metal powder into a plurality of individual non-ferrous support casings, sealing the support casings, affixing the support casings to the means for supporting said diaphragm and then charging the unmagnetized metal powder.

10. The transducer of claim 1 wherein said electrical conductor pattern includes a plurality of coils.

11. The transducer of claim 10 wherein each coil of said plurality of coils is connected to an identical signal source.

12. A transducer system including a plurality of transducers of the type set forth in claim 11 wherein each transducer has the identical frequency response.

13. The transducer system of claim 12 wherein two or more of said plurality of transducers are adapted to simultaneously perform different functions.

14. The transducer system of claim 12 wherein two or more of said plurality of transducers are adapted to sequentially perform different functions.

15. The transducer system of claim 12 wherein at least one of said plurality of transducers is adapted to produce sound as an audio loudspeaker and another of said plurality of transducers is adapted to detect sound as a microphone.

16. A transducer system including a plurality of transducers of the type set forth in claim 11 wherein two or more of said transducers are optimized for different frequency response ranges.

17. The transducer of claim 16 wherein said frequency response ranges are optimized by selecting different materials for said insulating layers.

18. The transducer of claim 10 wherein said plurality of coils are independently addressable by being connected in parallel to a plurality of signal sources.

19. The transducer of claim 10 wherein two or more coils of said plurality of coils are configured to be optimized for different frequency response ranges.

20. The transducer of claim 10 wherein two or more of said plurality of coils simultaneously perform different functions.

21. The transducer of claim 10 wherein two or more of said plurality of coils sequentially perform different functions.

22. The transducer of claim 21 wherein at least one of said plurality of coils produces sound as an audio loudspeaker and another of said plurality of coils detects sound as a microphone.

* * * * *